US006132325A

United States Patent [19]

Bertolotti

[11] Patent Number: 6,132,325

[45] Date of Patent: Oct. 17, 2000

[54] INTERLOCKING STRING NETWORK FOR SPORT RACKETS

[76] Inventor: Fabio P Bertolotti, Auf der Lieth 32, Göttingen 37077, Germany

[21] Appl. No.: 09/088,602

[22] Filed: Jun. 1, 1998

Related U.S. Application Data

[60] Provisional application No. 60/050,678, Jun. 25, 1997.

[51] Int. Cl.[7] ..... A63B 51/00; A63B 51/02; A63B 51/10

[52] U.S. Cl. ..... 473/543; 473/521; 473/522

[58] Field of Search ..... 473/543, 534, 473/516, 520, 521, 522, 524, 539

[56] References Cited

U.S. PATENT DOCUMENTS

| | | | |
|---|---|---|---|
| Re. 30,555 | 3/1981 | Ferrari . | |
| D. 258,376 | 2/1981 | Kutt et al. . | |
| 3,834,699 | 9/1974 | Pass | 473/543 |
| 3,921,979 | 11/1975 | Dischinger . | |
| 3,930,648 | 1/1976 | Brown | 473/539 |
| 4,005,863 | 2/1977 | Henry . | |
| 4,013,289 | 3/1977 | Kaminstein . | |
| 4,078,796 | 3/1978 | Gibello . | |
| 4,093,220 | 6/1978 | Prewarski . | |
| 4,095,790 | 6/1978 | Swiecicki | 473/532 |
| 4,118,029 | 10/1978 | Septier . | |
| 4,131,279 | 12/1978 | Ogden . | |
| 4,149,722 | 4/1979 | Yager . | |
| 4,162,791 | 7/1979 | Seehase . | |
| 4,163,533 | 8/1979 | Renfro . | |
| 4,163,553 | 8/1979 | Renfro . | |
| 4,168,065 | 9/1979 | Goransson . | |
| 4,183,200 | 1/1980 | Bajaj . | |
| 4,184,679 | 1/1980 | Mishel . | |
| 4,190,249 | 2/1980 | Fischer . | |
| 4,231,575 | 11/1980 | Kutt et al. . | |
| 4,238,262 | 12/1980 | Fishel . | |
| 4,249,731 | 2/1981 | Amster . | |
| 4,273,331 | 6/1981 | Fischer . | |
| 4,275,117 | 6/1981 | Crandall . | |
| 4,288,977 | 9/1981 | Csaky et al. . | |
| 4,306,410 | 12/1981 | Nakamura et al. . | |
| 4,309,033 | 1/1982 | Parker, Jr. et al. | 473/540 |
| 4,318,545 | 3/1982 | Husted . | |
| 4,326,713 | 4/1982 | Balaban . | |
| 4,339,130 | 7/1982 | Husted . | |
| 4,339,499 | 7/1982 | Tappe et al. . | |
| 4,348,024 | 9/1982 | Balaban . | |
| 4,349,198 | 9/1982 | Stelck . | |
| 4,359,213 | 11/1982 | Bachman et al. . | |
| 4,368,886 | 1/1983 | Graf . | |
| 4,377,288 | 3/1983 | Sulprizio . | |
| 4,382,358 | 5/1983 | Tappel et al. . | |
| 4,391,088 | 7/1983 | Salsky et al. . | |
| 4,391,391 | 7/1983 | Robaldo | 222/478 |
| 4,395,458 | 7/1983 | Huang . | |
| 4,440,392 | 4/1984 | Popplewell . | |
| 4,441,712 | 4/1984 | Guthke | 473/541 |
| 4,455,021 | 6/1984 | Berque . | |
| 4,458,898 | 7/1984 | Boden . | |
| 4,462,591 | 7/1984 | Kenworthy | 473/543 |
| 4,488,722 | 12/1984 | Harz . | |
| 4,530,206 | 7/1985 | Benichou et al. . | |
| 4,565,061 | 1/1986 | Durbin . | |
| 4,568,415 | 2/1986 | Woltron . | |
| 4,586,708 | 5/1986 | Smith et al. . | |
| 4,593,905 | 6/1986 | Abel . | |
| 4,595,201 | 6/1986 | Fischer . | |
| 4,597,576 | 7/1986 | Haythornthwaite . | |

(List continued on next page.)

*Primary Examiner*—Jeanette Chapman
*Assistant Examiner*—M. Chambers
*Attorney, Agent, or Firm*—John P. Sinnott

[57] ABSTRACT

The invention is an improved sports racket comprising streamlined transversal strings and streamlined longitudinal strings with surface indentations that permit the strings to lock into each other at the string crossings so the strings do not move with respect to each other and also stay oriented so as to minimize wind resitance during the swinging motion of the sports racket before and after ball contact. The invention includes fixing means for assembly of the strings in the sports racket.

10 Claims, 12 Drawing Sheets

U.S. PATENT DOCUMENTS 4,681,319 7/1987 Zilinskas ..... 473/540
4,685,676 8/1987 Boden .
4,741,531 5/1988 Szedressy ..... 473/540
4,750,742 6/1988 Coupar .
4,754,968 7/1988 Fischer .
4,805,393 2/1989 Reta .
4,834,383 5/1989 Woehrle et al. .
4,835,036 5/1989 Woltron et al. .
4,863,168 9/1989 Anderka et al. .
4,909,510 3/1990 Sabatjian .
4,909,511 3/1990 DeVille et al. .
4,913,430 4/1990 Lichtenstein .
4,949,968 8/1990 Korte-Jungermann .
5,037,097 8/1991 Svoma et al. .
5,090,188 2/1992 Lin et al. .
5,141,227 8/1992 Flamm ..... 473/543
5,141,228 8/1992 Soong .
5,145,172 9/1992 Takashima .
5,150,896 9/1992 Holmes .
5,158,285 10/1992 Flamm .
5,158,286 10/1992 Soong .
5,186,459 2/1993 Korte-Jungermann .
5,192,072 3/1993 Hong .
5,303,918 4/1994 Liu .
5,306,004 4/1994 Soong .
5,342,045 8/1994 Feeney .
5,346,212 9/1994 Kuebler .
5,383,662 1/1995 Gabrielidis .
5,406,827 4/1995 Boyden .
5,419,963 5/1995 Kubler .
5,423,532 6/1995 Huang .
5,443,575 8/1995 Huang .
5,458,331 10/1995 Bothwell .
5,470,066 11/1995 Soong .
5,478,072 12/1995 Kanno et al. .
5,536,005 7/1996 Koff ..... 473/543
5,538,243 7/1996 Yamamoto et al. .
5,570,883 11/1996 Csabai ..... 473/543
5,879,248 3/1999 Marsico ..... 473/534

INTERLOCKING STRING NETWORK FOR SPORT RACKETS

CROSS REFERENCE TO RELATED APPLICATION

This is a non-provisional case, which is a continuation of provisional application series code 64836, U.S. Ser. No. 60/050,678, filed Jun. 25, 1997.

Statement as to Rights to inventions made under Federally sponsored research and development: Not applicable

BACKGROUND OF THE INVENTION

1. Field of the Invention

This invention relates to a stringing for a sports racket such as, but not limited to, a tennis racket or a racket-ball racket.

2. Background Information

A patent search was conducted, and the following patents were discovered:

| | | |
|---|---|---|
| 3,834,699 | 09/10/74 | Pass |
| 3,921,979 | 11/25/75 | Dischinger |
| 4,005,863 | 02/01/77 | Henry |
| 4,078,796 | 03/14/78 | Gibello |
| 4,168,065 | 09/18/79 | Goransson |
| 4,249,731 | 02/10/81 | Amster |
| 4,368,886 | 01/18/83 | Graf |
| 4,377,288 | 03/22/83 | Sulprizio |
| 4,391,391 | 07/05/83 | Robaldo |
| 4,458,898 | 07/10/84 | Boden |
| 4,593,905 | 06/10/86 | Abel |
| 4,597,576 | 07/01/86 | Haythornthwaite |
| 4,681,319 | 07/21/87 | Zilinskas |
| 4,685,676 | 08/11/87 | Boden |
| 4,741,531 | 05/03/88 | Szedressy |
| 4,863,168 | 09/05/89 | Anderka et al. |
| 4,913,430 | 04/03/90 | Lichtenstein |
| 4,949,968 | 08/21/90 | Korte-Jungermann |
| 5,141,227 | 08/25/92 | Flamm |
| 5,141,228 | 08/25/92 | Soong |
| 5,158,285 | 10/27/92 | Flamm |
| 5,303,918 | 04/19/94 | Liu |
| 5,470,066 | 11/28/95 | Soong |

Conventional tennis rackets are strung with strings passed above and below each other to produce a woven string network. Since the strings are not bonded at their crossover points, the pattern of the string network may deform when the ball is struck by a racket with an upwards or downwards component of motion, such as that used by players wishing to place spin on the ball. The movement of the strings relative to one another produces wear through attrition and leads to premature string failure. This effect is accentuated when the tennis game is played on clay, where clay micro particles are brought to the racket by the tennis ball and, upon reaching the location of string attrition, accelerate the process of wear.

U.S. Pat. No. 4,741,531 by Szedressy and 4,949,968 by Korte-Jungermann permit replacing a single broken string without rebuilding the entire string network. These designs share the basic idea of building the string network with individual string segments that traverse the string network only once and are attached to the racket frame at oppositely disposed locations via a fixing means. In both cases, extra tension must be applied in the process of stringing the racket in order to compensate for a string shortening caused by a yield of the fixing means in the string axial direction following the release of the string by the string tensioning means. The axial yield alters the string tension and complicates the stringing process.

As will be seen from the subsequent description of the preferred embodiedment of the present invention, these and other shortcomings of the prior art are overcome.

SUMMARY OF THE INVENTION

The preferred embodiment of the present invention has a new string design wherein strings interlock with one another at the string crossings. The interlocking is achieved through matching surface indentations on the strings at the location of string crossings, the matching surface indentations allowing lateral forces to be transmitted between the crossing strings.

The interlocking strings are woven in the usual interlaced pattern and placed under axial tension, wherein the combination of tension and the matching surface indentations allows the crossing strings to transmit both lateral forces and bending moments to one another, thus maintaining the strings in their relative position and orientation during, and after, the transient motion of the string network resulting from the impact between the string network and a sports ball. Consequently, strings with aerodymanic cross-sectional area can maintain the correct orientation of least aerodynamic drag.

The string attachment to the frame is accomplished by a fixing means wherein the desired radial string compression is produced via a wedging action between a string clamping member and a pressing means, with the string clamping member being also prevented to move in the string axial direction.

BRIEF DESCRIPTION OF THE DRAWINGS

The invention is herein described in greater detail by means of embodiments as illustrated in the drawings in which.

DESCRIPTION OF THE PREFERRED EMBODIMENTS

Within the specification and the claims, the following words carry the meaning assigned below:

string network: Given a set of crossing strings touching at the locations of string crossings, the string network is that portion of the set of strings that lies within the periphery described by the outermost string crossings;

substantially planar string network: a string network whose strings lie within two bounding parallel planes with the minimum distance between the two bounding planes being essentially equal to twice the maximum thickness of any one string. The mid-plane of the substantially planar string network is the plane lying parallel to the bounding planes and dividing the string network into two essentially equal parts;

surface indentation (in a string) : a change in surface geometry to form a recess in a string, the recess having a maximum width less than or substantially equal to the maximum string width within the string network the recess running essentially normal to the longitudinal axis of the string so as to be localized to the string-crossing area.

no rotational symmetry: a property of a body, whereby only a rotation of 360 degrees, or an integer multiple thereof, about a specified axis brings the body into an orientation that is indistinguishable from the original orientation.

unique angle: the value in degrees after integer multiples of 360 degrees are added or subtracted to a given angle to make the value equal or greater than zero degrees, and less than 360 degrees.

string enlarged section: a portion of the string having an enlarged cross-sectional area, with the enlargement extending over a section of the length of the string.

streamlined cross-section: a cross-section characterized by a major axis and a minor axis perpendicular thereto, the body formed by extruding the cross-section having lower aerodynamic drag than the drag of a cylinder having equal cross-sectional area;

surface normal: The direction obtained by averaging the point-wise perpendicular direction to the surface over all points on the surface or over all points in a specified region of the surface.

first fixing means: A means for fixing a string to the frame of a sports racket, said means employing a fixing procedure necessitating substantially the entire length of the string to be threaded through said means.

second fixing means: A means for fixing a string to the frame of a sports racket, said means employing a fixing procedure not necessitating the entire length of the string to be threaded through said means.

The drawings represent only the preferred form of the invention and are only to be considered as examples.

Figure 1:
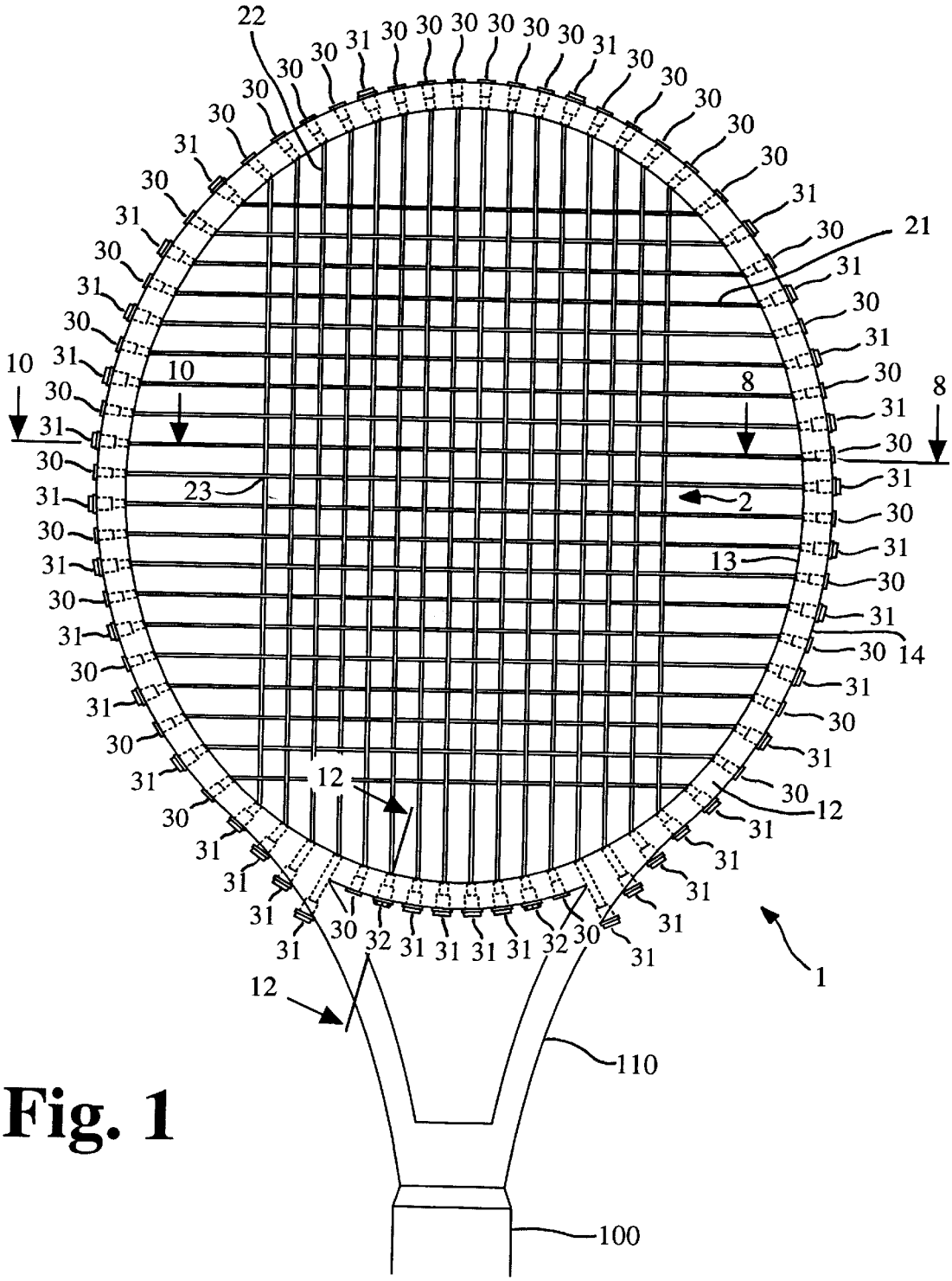
FIG. 1 is a plan view of a portion of a racket according to the first embodiment of the invention.
Figure 2:
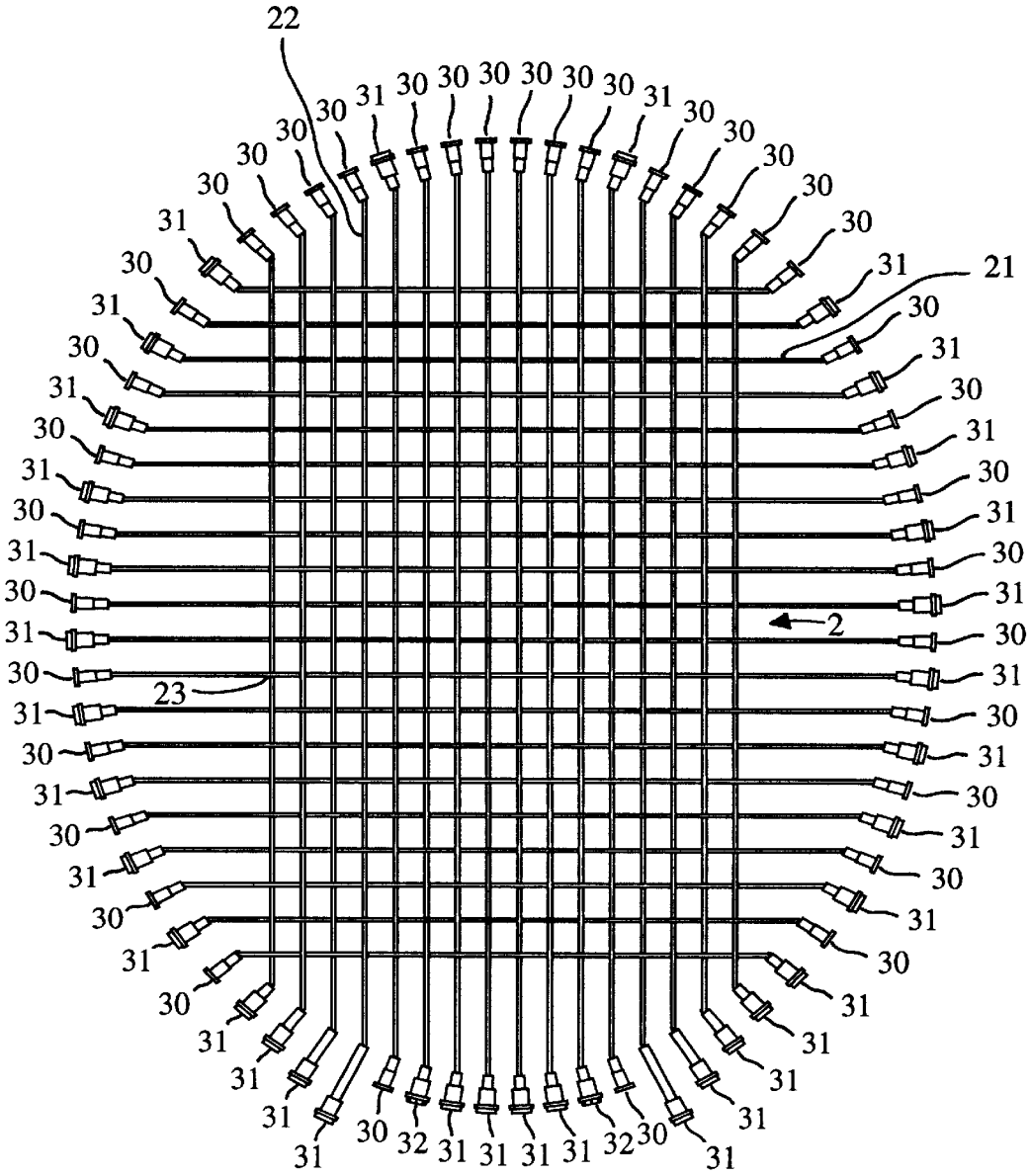
FIG. 2 is a plan view of the interlocking string network 2 and the fixing means 30, 31 and 32 shown separate from the the racket frame.
Figure 3:
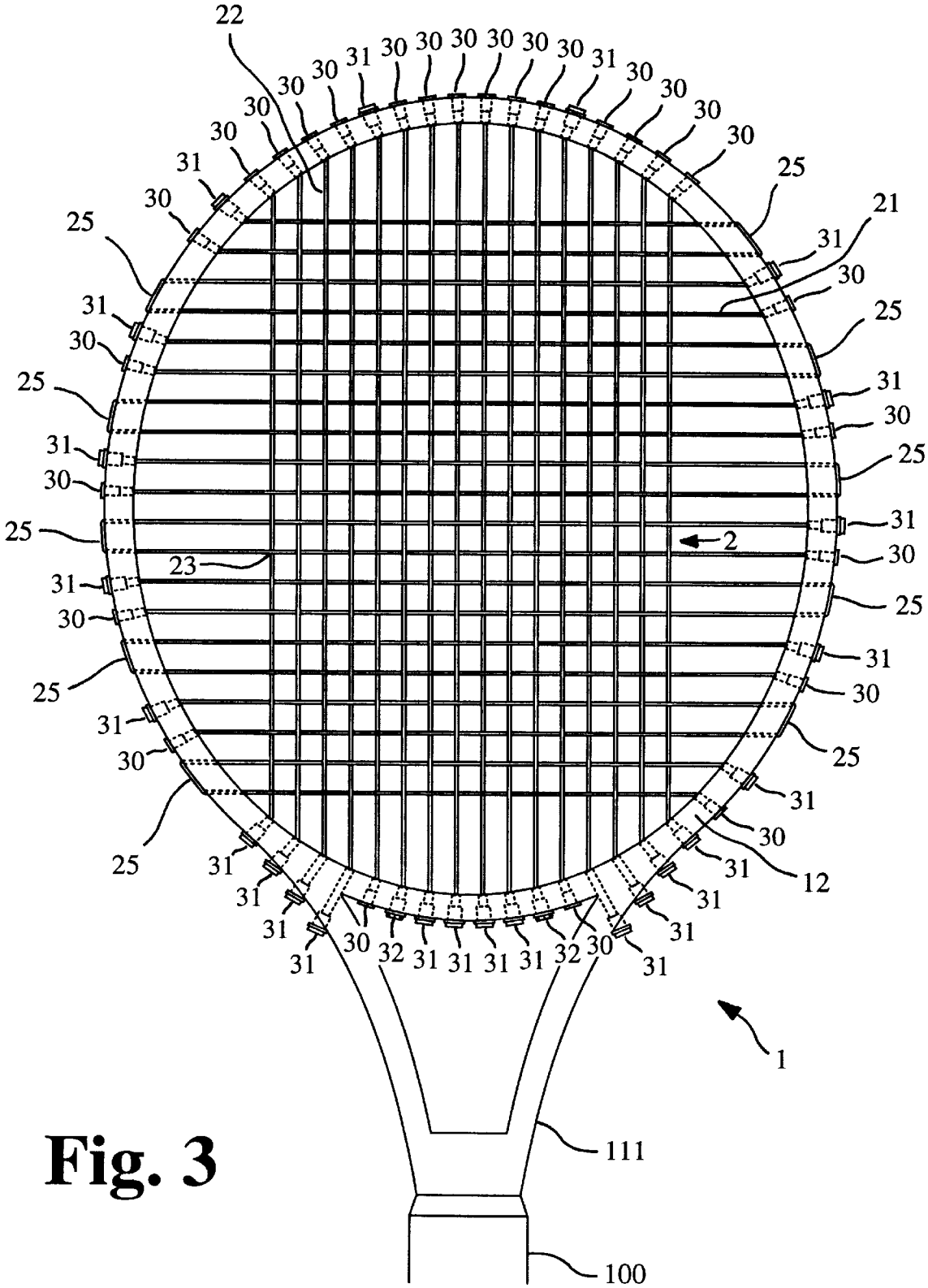
FIG. 3 is a plan view of a portion of a racket with fixing means including a conventional hole-loop arrangement 25; embodiment of the invention.

FIGS. 1 and 2 show the preferred embodiment of the sport racket of this invention. The sport racket has a frame 1 having a handle 100, only partially shown, a throat 110 and a head 12. The head has an outer head surface 14 and an inner head surface 13 that defines a central opening spanned by a plurality of transversal strings 21 running essentially parallel to each other and a plurality of longitudinal strings 22 running substantially orthogonal to, and being interwoven with, the transversal strings to form a substantially planar string network 2. The transversal strings and the longitudinal strings are secured to the frame by means for securing strings to the frame, such as a first fixing means 30, or a second fixing means 31, or a conventional hole and loop combination 25.

Figure 4:
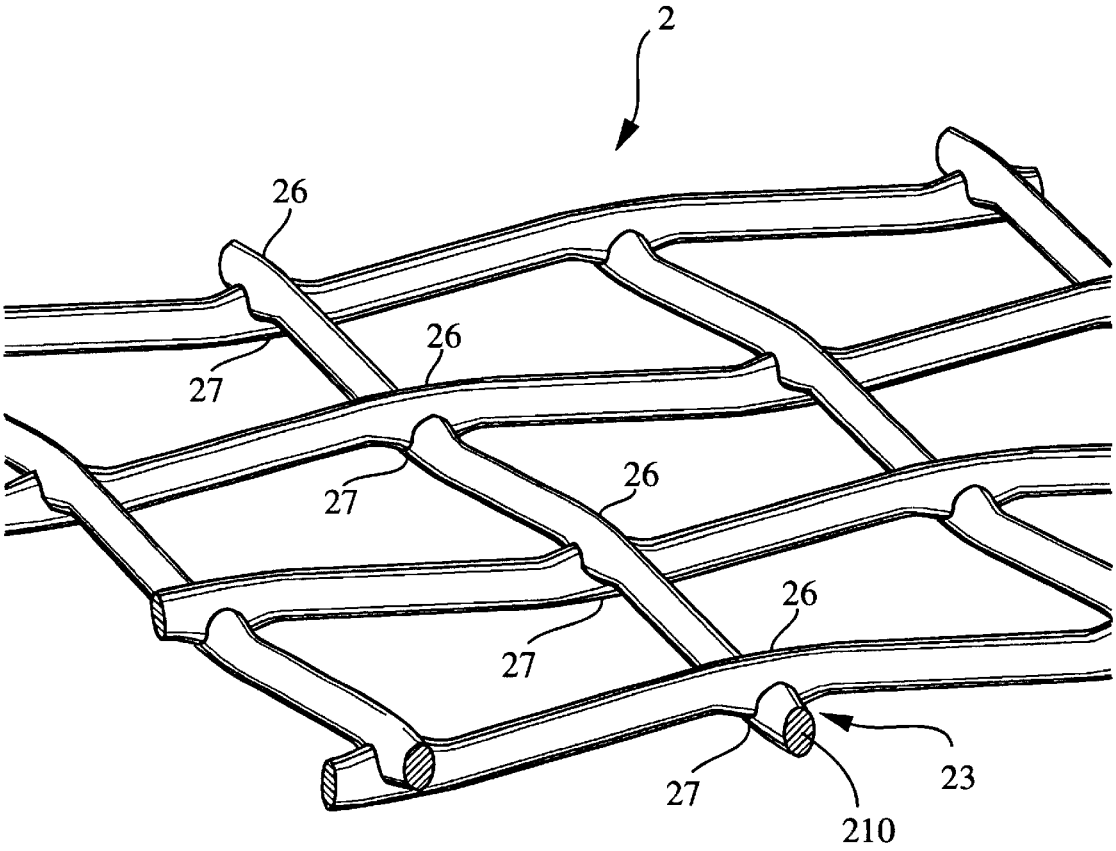
FIG. 4 is a close-up view, in perspective, of the string network showing the string crossings.

Each point of contact between transversal and longitudinal strings defines a string crossing. One such string crossing is indicated at 23. In the neighborhood of each string crossing we identify an upper crossing string 26 and a lower crossing string 27 (see FIG. 4).

At each string crossing, the upper crossing string has a first surface indentation 40 opening in the downward direction, and the lower crossing string has a second surface indentation 41 opening in the upward direction. The first and second surface indentations are made to match with and mate with each other to form a common contact surface.

Figure 5:
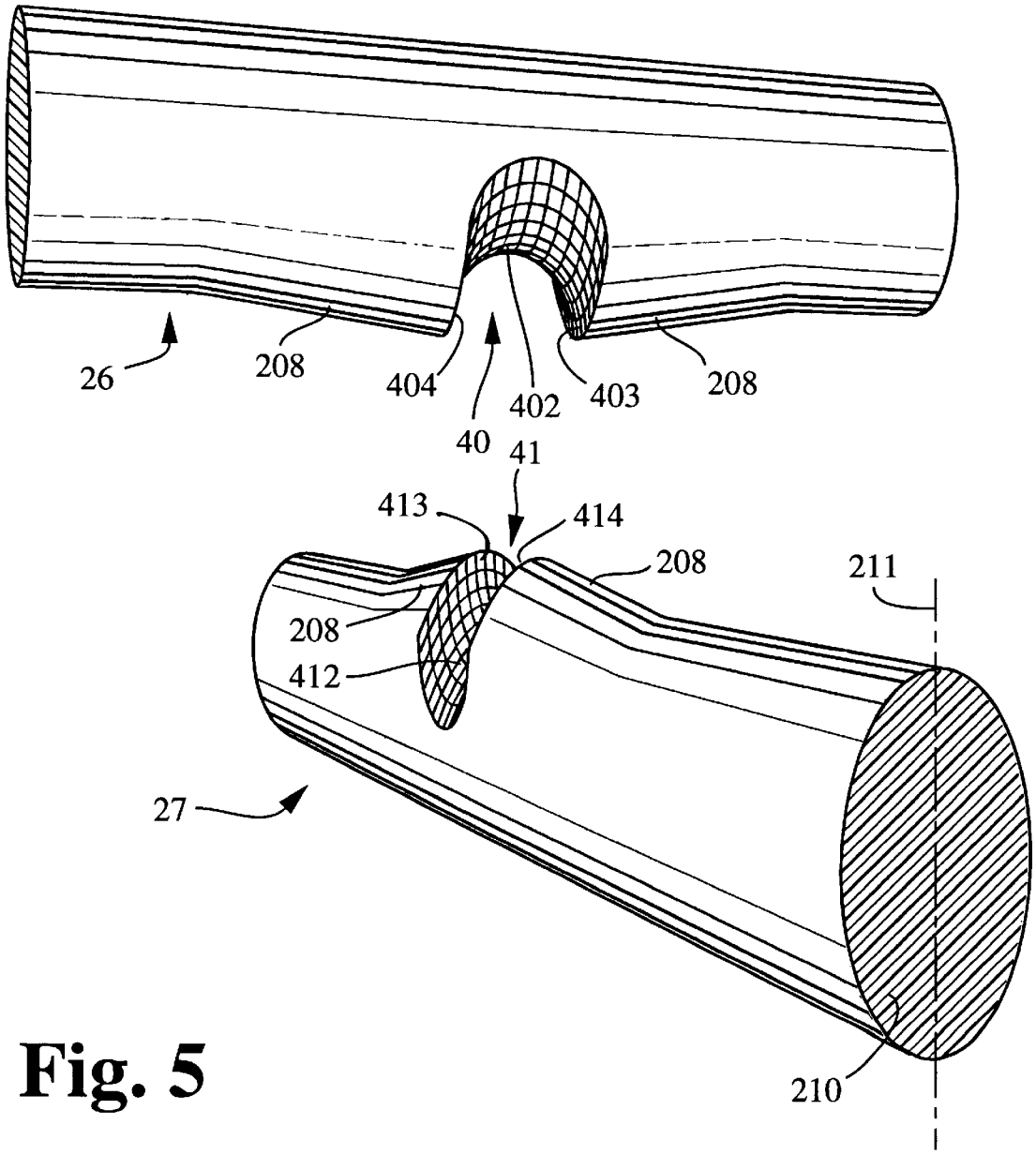
FIG. 5 is a close-up view, shown in perspective, of a string crossing in which the upper crossing string and the lower crossing string are separated from one another to reveal the preferred shape of the interlocking surface indentations.

An example of the preferred form of the first surface indentation and of the second surface indentation is shown in FIG. 5. In this figure a grid is painted on both the first and second surface indentations to help communicated the surface shape.

Upon mutual string contact the first surface indentation 40 makes full contact with the second surface indentation 41 to form the common contact surface. In particular, the first surface indentation 40 contains first lateral surface regions 403 and 404, each having the surface normal tilted away from the perpendicular direction to the mid-plane of the string network. Similarly, the second surface indentation 41 contains second lateral surface regions 413 and 414, each having the surface normal tilted away from the perpendicular direction to the mid-plane of the string network. Upon mutual string contact the first and second lateral surface regions meet to form a lateral portion of the common contact surface that carries compressive stresses leading to lateral forces that oppose the movement of the upper crossing string 26 relative to the lower crossing string 27.

The transversal strings and longitudinal strings have at each string crossing a bulge 208 to provide an enlarged cross-section in the region of the string crossing. At the location of each surface indentation, the bulge produces a minimum string cross-sectional area that can carry, with a desired margin of safety, the design tension anticipated to occur in the string. The bulge also allows surface indentations with larger lateral surface regions.

Figure 6:
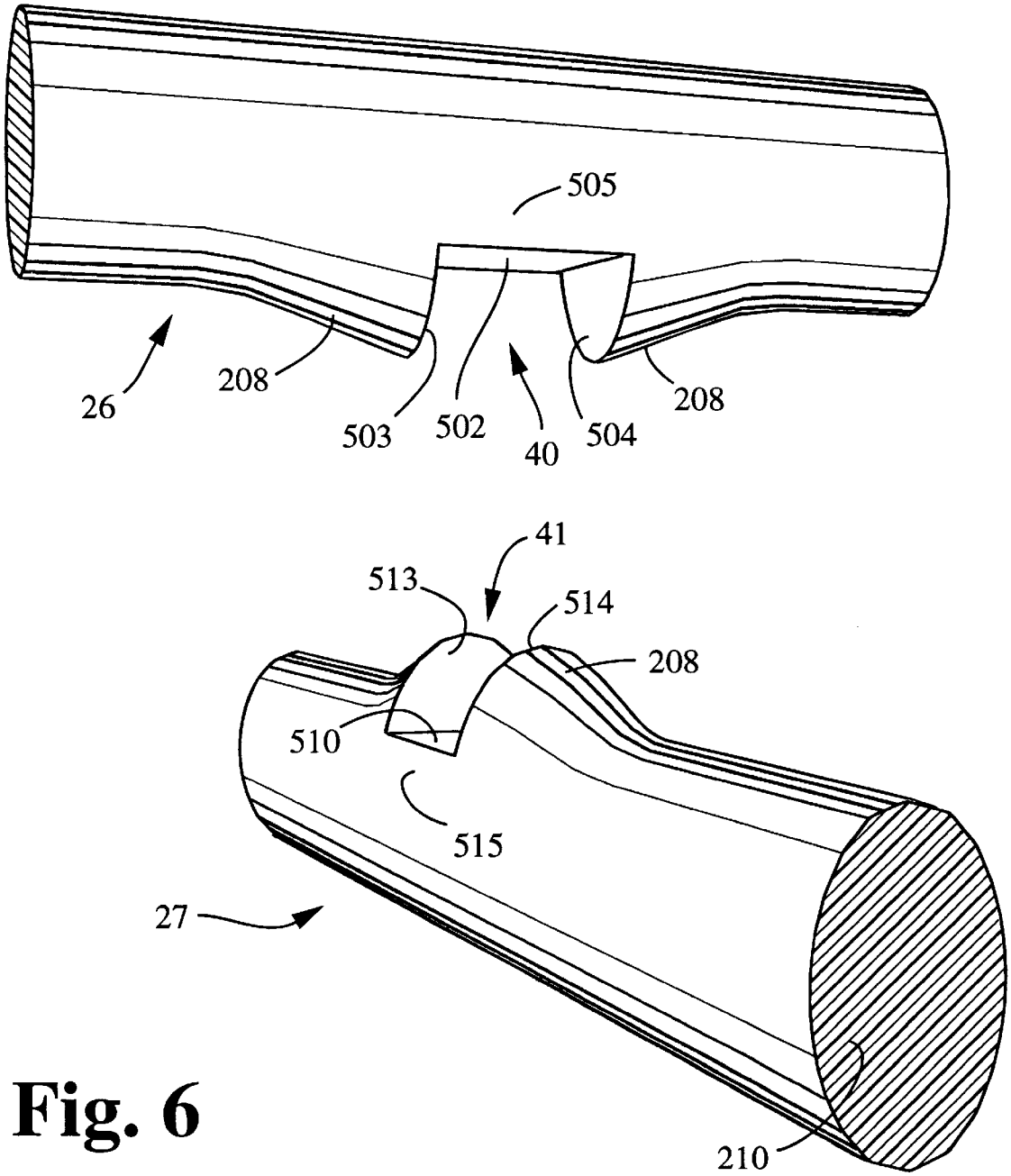
FIG. 6 is a close-up view, shown in perspective, of a string crossing in which the upper crossing string and the lower crossing string are separated from one another to reveal the shape of the interlocking surface indentations in another embodiment of the invention.

In another embodiment on the invention, shown in FIG. 6, the first surface indentation 40 on the upper crossing string 26 has an essentially rectangular shape that mates and matches with the second surface indentation 41 of essentially rectangular shape on the lower crossing string 27 upon mutual string contact. The first surface indentation 40 has first lateral surface regions 503 and 504 separated from one another by a a first frontal surface region 502, with the first lateral surface regions each having the surface normal tilted away from the perpendicular direction to the mid-plane of the string network. Similarly, the second surface indentation 41 has second lateral surface regions 513 and 514 separated from one another by a second frontal surface region 510, with the second lateral surface regions each having the surface normal tilted away from the perpendicular direction to the mid-plane of the planar string network.

Upon mutual string contact the first frontal surface region 502 contacts the second frontal surface region 510 and these two surface are pressed against each other in the presence of string tension. Furthermore, the first lateral surface regions 503 and 504 contact the lower crossing string at 515 and at the corresponding location on the other side of the lower crossing string, respectively, while the second lateral surface regions 513 and 514 contact the upper crossing string at 515 and at the corresponding location on the other side of the upper crossing string, respectively.

The sharing of the common contact surface, rather than just a small region essentially limited to a point as in conventional string networks, allows the center of force acting between the upper crossing string and the lower crossing string to shift relative to the longitudinal axis of either crossing string. The shift between the center of force and the perpendicular component of the axial force carried by the upper and the lower crossing string creates a force couple that can hold the upper crossing string and the lower crossing string in their relative position and orientation during the transient motion of the string network resulting from the impact between the string network and a sports ball.

Since the strings maintain their relative position, the strings can have a stream-lined cross-section oriented to yield lower aerodynamic drag when the string network is moved in the direction essentially perpendicular to the mid-plane of the string network, such as during the swinging motion of the sport racket. A streamlined cross-section of elliptical form with major axis to minor axis ratio of 1.6 is shown at 210. Although a substantially higher value for this ratio will further reduce the drag when the air-flow is in the direction of the major axis, the substantially higher ratio is undesirable when the racket is swinged with an upwards or downwards component of motion, such as the swing made to impart spin on the ball. In this motion, the air-flow is at an oblique direction with respect to the major axis, and the substantially higher value of major-minor axis ratio will lead to a loss of aerodynamic efficiency.

The string structure

Figures 7A, 7B:
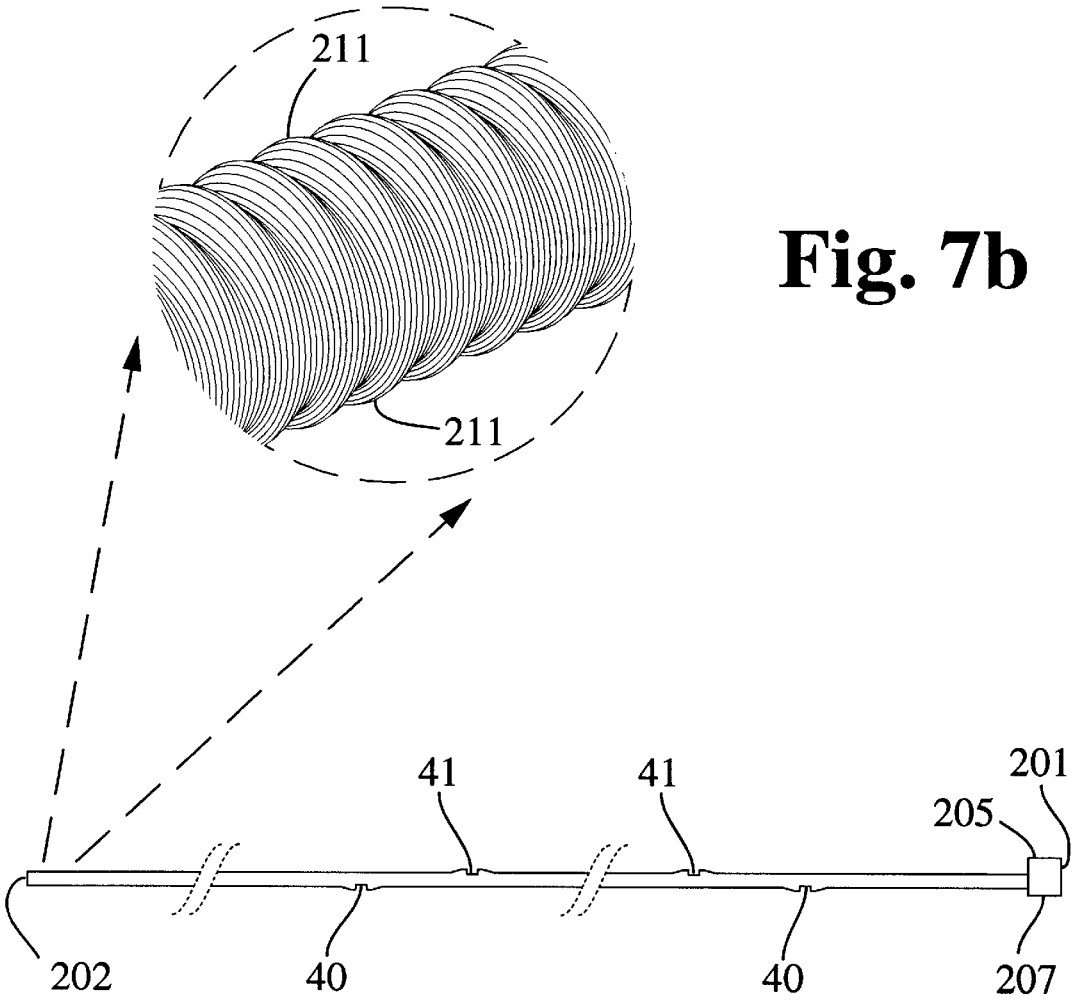
FIG. 7*a* is a side view of a single isolated string.
FIG. 7*b* is a magnified view, shown in perspective, of the end section of the string in FIG. 5*a,* the magnified view showing the grooves on the string surface.

A representative transversal string 21, isolated form the string network and the frame, is shown in FIG. 7*a*. A representative longitudinal string has essentially the same string structure as the transversal string. The string contains the first surface indentation 40 at the locations along the string corresponding to crossings in which the string is the upper crossing string. Similarly, the string contains the second surface indentation 41 at the locations along the string corresponding to crossings in which the string is the lower crossing string.

Figure 8:
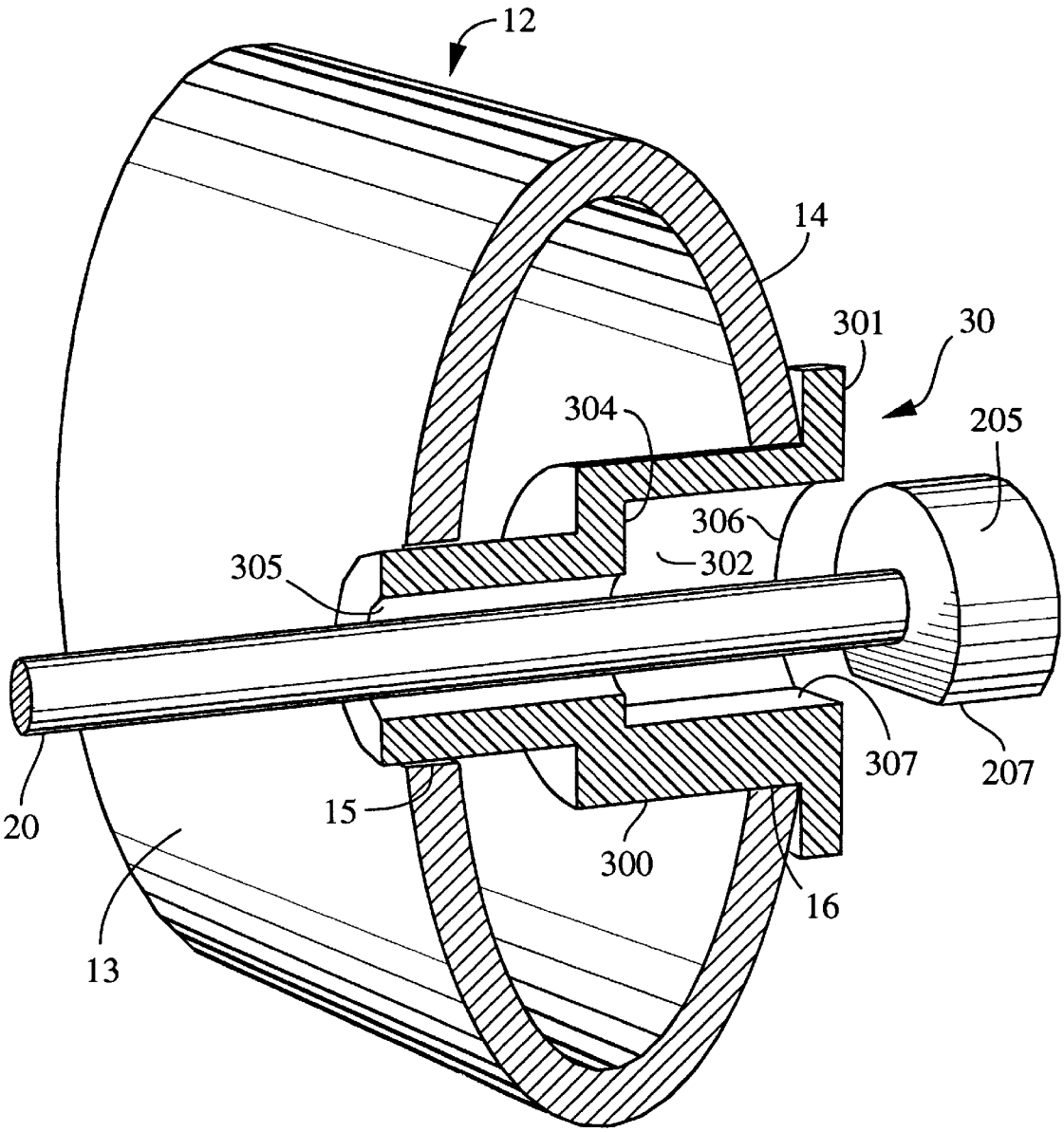
FIG. 8 is an enlarged cross-section taken along line 8–8 in FIG. 1, showing the first fixing means.

The string has a first free-end 201 and a second free-end 202 for attachment to the first fixing means and second fixing means, respectively. The first free-end has a string enlarged section 205. A perspective view of the string enlarged section 205 is shown in FIG. 8. The string enlarged section 205 has a secant section removed to form a string reference plane 207 that is oriented with a predetermined angle about the longitudinal axis of the string with respect to the first and second surface indentations. The removal of the secant section makes the string enlarged section have no rotational symmetry about the longitudinal axis of the string.

The string portion extending from the last surface indentation (counting from the first free-end 201 to the second free-end 202) contains string surface corrugations 211 oriented essentially perpendicular to the longitudinal axis of the string. An example of the string surface corrugations is shown in FIG. 7*b*. The string surface corrugations improve the fixing ability of the string to the second fixing means, described below.

The individual transversal or longitudinal string is produced through the injection molding of a resilient plastic material, such as nylon or an equivalent polyamide, or polyester, into a dye. Whiskers of glass, aramid fibers or graphite can be included in the injected material to increase the tensile strength of the composite material.

The spacing between surface indentations along the length of the string and the spacing between the surface indentations and the string enlarged section 205, as shown in FIG. 7*a,* depend on the amount of axial strain the string undergoes once the string is strung to the frame. In particular, the spacing depends on the location of the string in the string network (i.e. the string length), on the string tension, and on the elastic modulus of the string. Consequently, each individual string is manufactured with its own particular length and with its own particular placement of the surface indentations, such that the string network fits a particular racket when each string is placed under its own particular, and desired, tension (i.e. the string's design-point tension).

In another embodiment of the invention, an adhesive, such as a cyano-acrylate based adhesive, is applied applied over the common contact surface to provide a strong bond at the string crossing, thus allowing the common contact surface to sustain the shear, compressive, and tensile stresses necessary to maintain the upper crossing string and the lower crossing string in their relative position and orientation during the transient motion of the string network resulting from the impact between the string network and a sports ball, even in the case when the strings are not interwoven within the substantially planar string network.

The fixing means

The first fixing means, shown at 30 in FIG. 8, is used to firmly hold the string enlarged section 205 of an individual string 20 to the frame 12 when the individual string 20 is placed under axial tension.

The first fixing means comprises a main body 300 fixedly attached to the frame and extending from the inner head surface 13 to the outer head surface 14. When the frame is hollow, the main body has preferably a flange 301 to block the inward motion of the main body into the frame, and, thus, help maintain the main body fixedly attached to the frame. The main body 300 has a first cavity 302 extending the length of the main body to produce a first opening 305 at the inner head surface and a second opening 306 at the outer head surface. The first cavity allows the individual string 20 to be threaded through the main body by passing the second free-end of the individual string through the second opening, through the first cavity, and through the first opening. Furthermore, the first cavity is shaped to receive the string enlarged section when the string enlarged section enters the first cavity through the second opening, the first cavity being shaped to block the string enlarged section from further inward movement into the first cavity once a predetermined advancement of the string enlarged section into the first cavity occurs. In the preferred embodiment, the string enlarged section is essentially of cylindrical form, and the first cavity contains a stopping surface 304 that contacts the string enlarged section and prevents further penetration of the string enlarged section into the first cavity. The portion of the first cavity receiving the string enlarged section is absent rotational symmetry in order to allow penetration of the string enlarged section when the string enlarged section is oriented with a predetermined angle to the frame. In the preferred embodiment, the first cavity contains a guide plane 307 that receives the string reference plane. Upon placement of tension in the individual string acting towards the string network, the string enlarged section firmly presses against the main body, effectively fixing the individual string to the frame.

Figure 9:
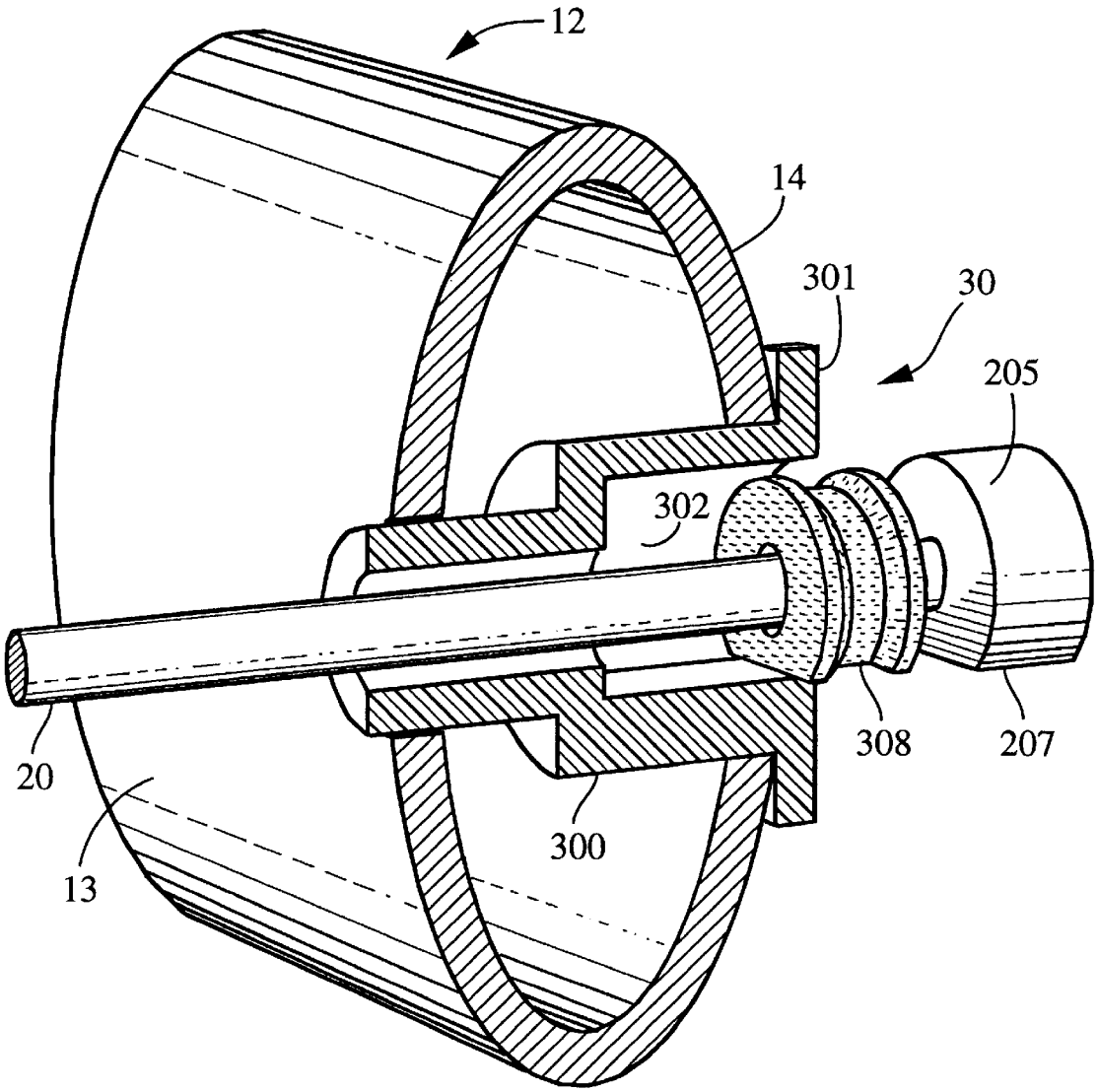
FIG. 9 is an enlarged cross-section taken along line 8—8 in FIG. 1, showing the first fixing means with the flexible spacer.
Figure 10:
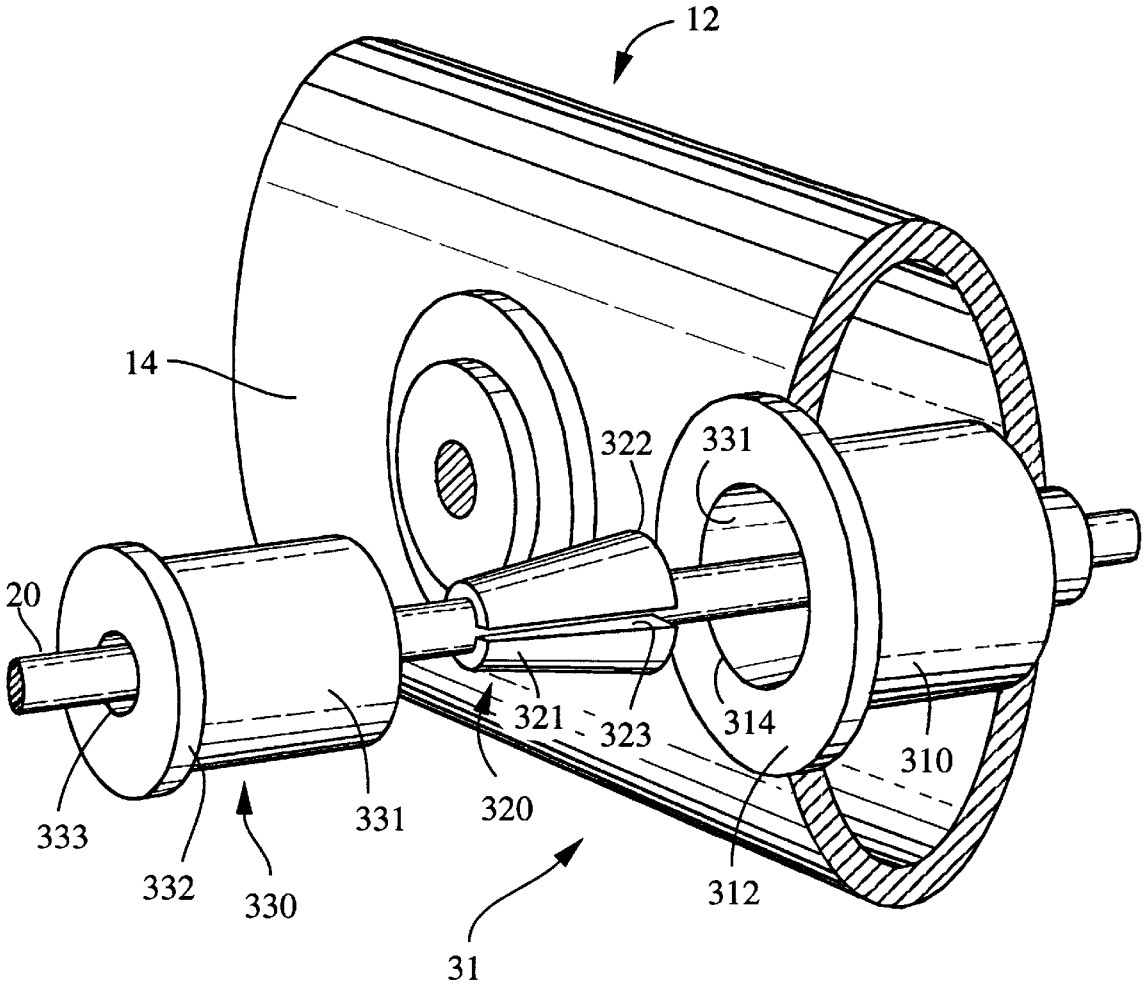
FIG. 10 is an enlarged cross-section taken along line 10—10 in FIG. 1, showing in full perspective the components of the second fixing means in an exploded view.

When the strings are made of a strong but stiff material, the string network may only yield a small amount upon impact with the game ball. Since several types of game balls are designed to dissipate energy on impact, the small yield of the string network causes the ball to deform too much upon impact and dissipate a significant fraction of its kinetic energy. In this case,. a flexible spacer 308 can be inserted between the surface of the main body facing the first cavity and the surface of the string enlarged section to absorb part of the kinetic energy of the arriving ball, and to return this energy to the departing ball. (See FIG. 9). The flexible spacer is made of a compliant material such as silicon rubber, exhibiting a substantially linear stress-strain relation, in the range of the compressive strains induced in the flexible spacer upon placement of the design-point tension in the individual string. For clarity, we define the state of compressive strain of the flexible spacer after the individual string is strung but before contact of the individual string with a sports ball as the nominal compressive state . The flexible spacer has a combination of elastic modulus and cross-sectional area that allows further compressive strain within the substantially linear stress-strain relation of the flexible material in the presence of further tension in the individual string brought about by the contact of a sports ball with the individual string during a sports game. For example, the flexible spacer 308 has a an outer diameter of 5 mm and in inner diameter of 1.4 mm for the string passage, creating a surface area normal to the longitudinal string axis of the string of about 18 square millimeters. The material is an elastomer selected to have an elastic modulus of 300 Newtons/mm$^2$, yielding a strain of 5 percent at a typical string loading of 28 kilograms. This strain is acceptably within the substantially linear range of elastomeric materials.

The additional compressive strain in the flexible element causes the length of the string between fixing means to lengthen, hence absorb part of the ball's kinetic energy. The flexible spacer returns to the nominal compressive state as the ball leaves the string network, thereby returning to the sport ball part of the ball's initial kinetic energy.

The second fixing means 31 is used to firmly hold the second free-end 202 of an individual string 20 to the frame 1. The second fixing means comprises an enclosure body 310, a string clamping member 320 and a pressing means 330. These three parts are made from a resilient and light-weight material, such as plastic.

The string clamping member 320 has an wedge shaped outer surface 321, preferably of conical form, ending with an edge 322. The string clamping member has an inner passage-way to allow the passage of the individual string 20 through the string clamping member when there are no compressive forces acting on the wedge shaped outer surface. The inner passageway contains transversal corrugations 325 (see FIG. 11*b*) to match the string surface corrugations 211 on the individual string. The string clamping member is made of a compliant material, such as nylon or similar polyamide, that allows the passage-way to radially contract when a compressive force is brought to bear on the wedge shaped outer surface. In the preferred embodiment, the radial contraction is aided by a cut 323 extending from the inner passage-way to the wedge shaped outer surface and running the entire length of the string clamping member.

The pressing means 330 has a cylindrical body 331, a small flange 332 connected to the cylindrical body, and a wedge shaped bore 335, preferably of conical form to match preferably conical form of the wedge shaped outer surface 321 of the string clamping member 320. The wedge shaped bore extends the entire length of the cylindrical body and the small flange so as to create a passage for the individual string through the pressing means. The wedge shaped bore opens in the direction away from the small flange, and is sized to completely receive the string clamping member 320. Upon full insertion of the string clamping member 320 into the pressing means 330, the surface of the wedge shaped bore 335 pushes in a wedge fashion against the wedge shaped outer surface 321, thereby providing a compressive force to the wedge shaped outer surface and causing the inner passage-way of the string clamping member to radially contract. The pressing means furthermore comprises a locking means, preferentially in the form of an engaging lip 336 located at the larger opening of the wedge shaped bore for engagement with the edge 322 of the string clamping member, the locking means locking the string clamping member inside the wedge shaped bore when the string clamping member is fully inserted into the wedge shaped bore.

The enclosure body 310 extends from the inner head surface 13 to the outer head surface 14 and is fixedly attached to the frame. When the frame is hollow, the enclosure body has preferably an enclosure flange 312 to block the inward motion of the enclosure body into the frame, and, thus, help maintain the enclosure body fixedly attached to the frame.

Figure 11A:
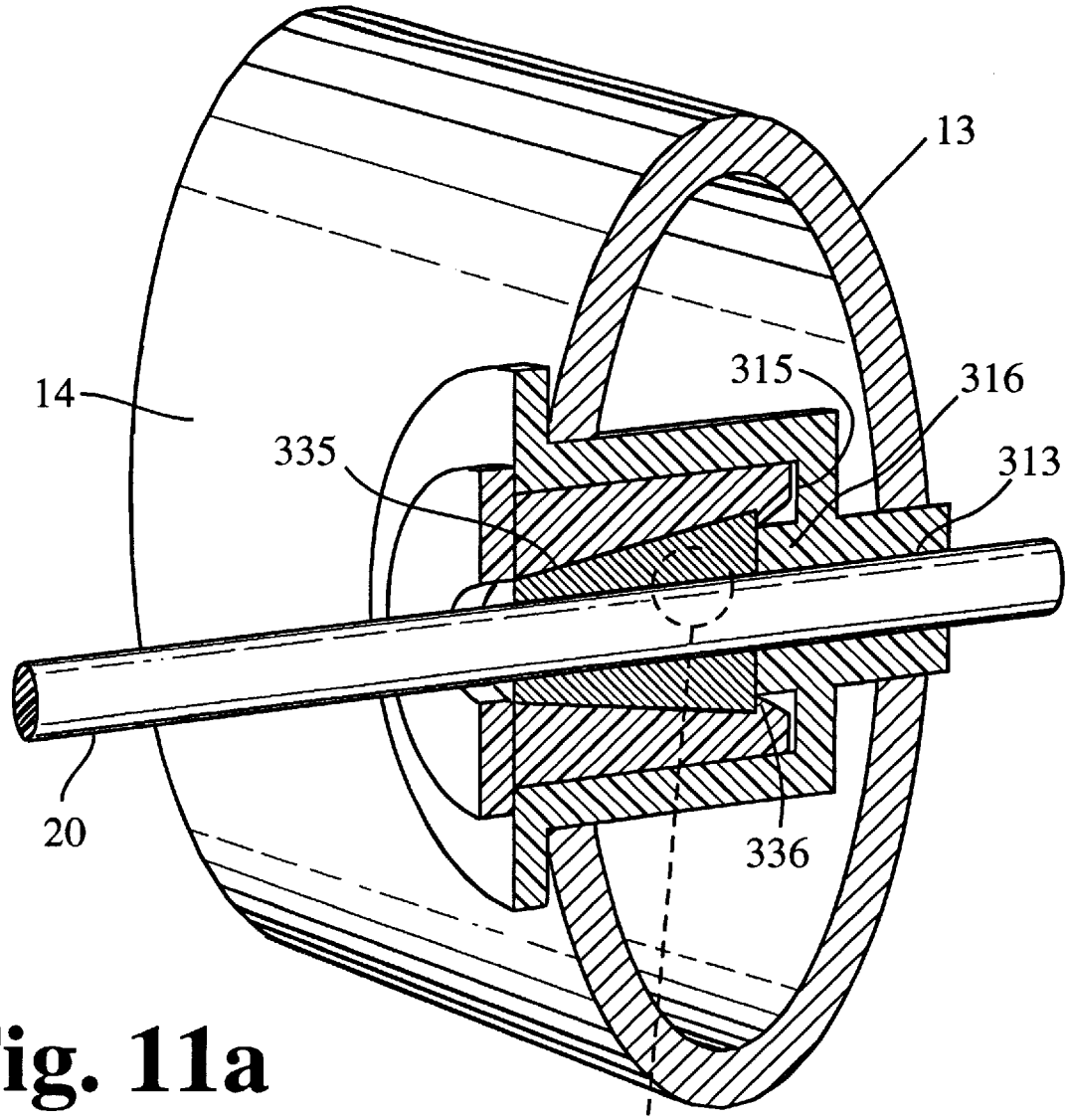
FIG. 11*a* is an enlarged section taken along line 10—10 in FIG. 1, showing the components of the second fixing means in the locked position.
Figure 11B:
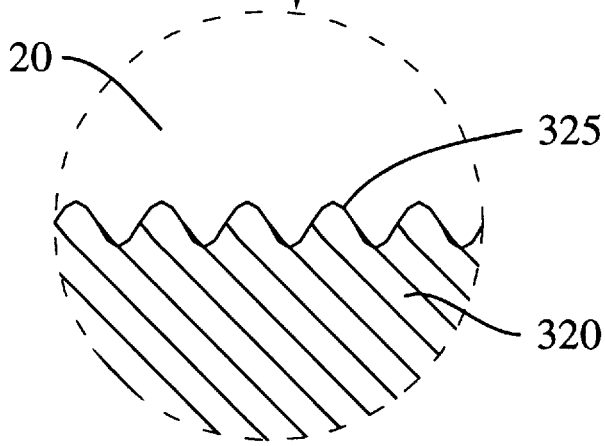
FIG. 11*b* is an enlargement of the area encircled by the dashed line in FIG. 11*a,* showing the grooves on the string clamping unit.
Figure 12:
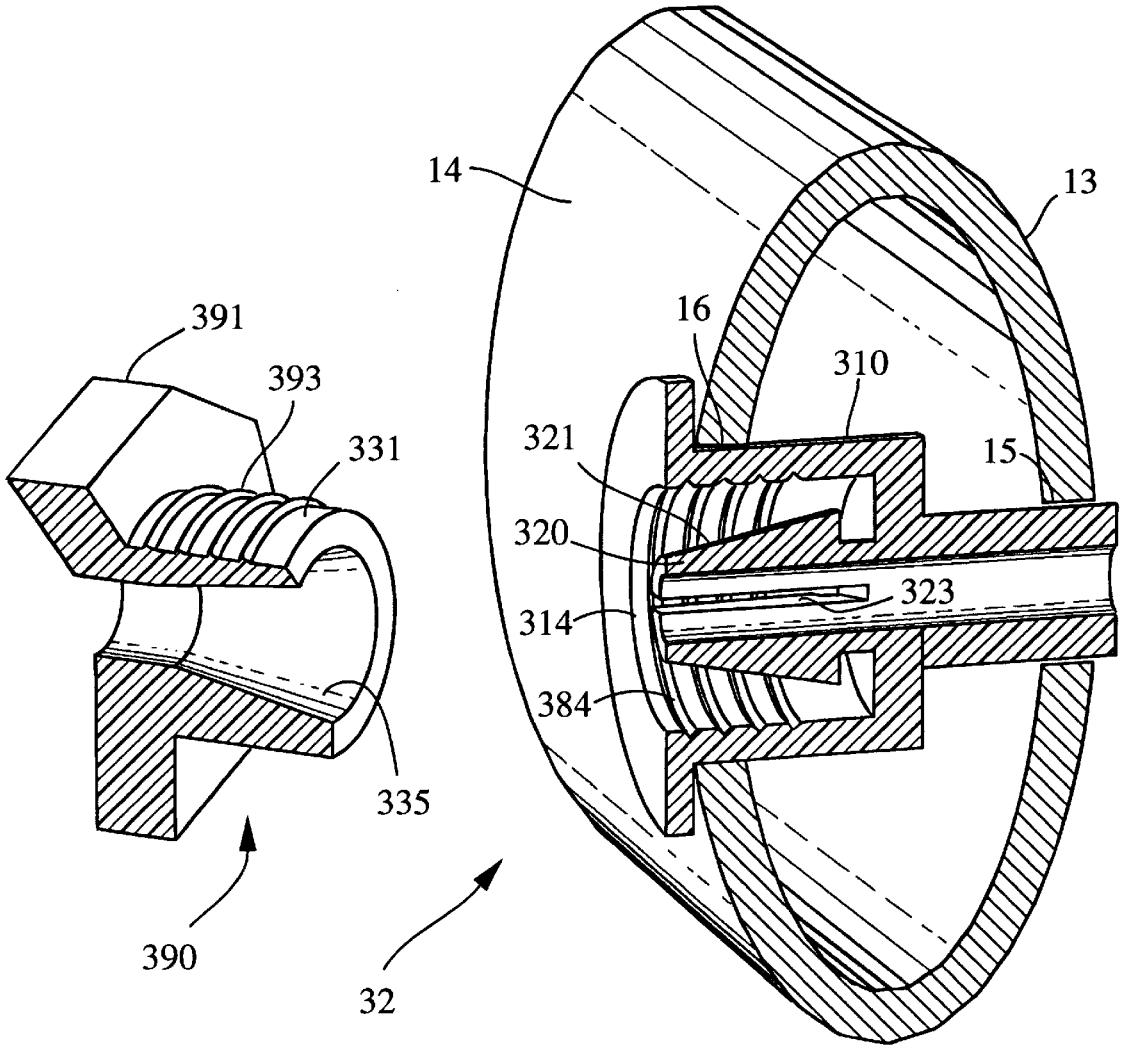
FIG. 12 is an enlarged section taken along line 12—12 in FIG. 1, showing the components of the modified second fixing means in an exploded view.

The enclosure body 310 contains a second cavity 311 extending through the enclosure flange to produce a main opening 314, and extending partially into the enclosure body to produce a base surface 315 (see FIG. 11*a*). The base surface is connected to the inner head surface by a simple bore 313 to allow the passage of the individual string through the enclosure body. Furthermore, the second cavity 311 is sized to receive through the main opening the cylindrical body 331 of the pressing means, but not the small flange 332 of the pressing means.

To fasten the individual string to the frame, the individual string is threaded through the enclosure body 310 in the direction from inner head surface to outer head surface, and further threaded through the string clamping member in the direction of decreasing thickness of the wedge shaped outer surface, and through the pressing means in the direction of decreasing cross-sectional area of the wedge shaped bore. The individual string then proceeds to a conventional string tensioner to receive the desired tension. Once the desired tension is reached, the string clamping member is slid along the individual string into the enclosure body until coming to rest against the base surface of the enclosure body. The enclosure body in the preferred embodiment has a protrusion 316 at the base surface 315. The protrusion separates the string clamping member from the enclosure body to make the edge 322 reachable by the engaging lip 336. Afterwards, the pressing means is inserted into the enclosure body and over the string clamping member, causing the wedge shaped bore to slide over the wedge shaped outer surface of the string clamping member and to cause a compressive force on the wedge shaped outer surface. Upon full insertion, the engaging lip 336 engages with the edge 322 to lock the pressing means and the string clamping member together. Since the protrusion prevents further motion of the string clamping member into the second cavity 311, the wedging action between the string clamping member and the pressing means causes the string clamping member to radially contract, whereby the surface of the passage-way in the string clamping member contracts and firmly presses against the individual string to fasten the individual string to the frame.

To remove the pressing means and the string clamping member form the enclosure body after the pressing means and the string clamping member are interlocked with each other, the individual string is cut. With each new individual string replacement, a new pressing means and a new clamping member are used.

There are locations on the head of the frame where the throat can interfere with the step of pushing the pressing means 330 into the enclosure body 310.

The second fixing means is modified for usage at these locations. A modified fixing means 32 comprises: the string clamping member, the second cavity within the enclosure body, and the pressing means are axis-symmetric about an axis aligned with the longitudinal axis of the individual string, allowing the pressing means to rotate inside the enclosure body and around the pressing means; the string clamping member and the protrusion are fixedly attached to the enclosure body; and the locking means comprises a first set of threads 384 on the enclosure body, and a second set of threads 393 on the outer surface of the pressing means, the second set of threads made to match and engagement with the first set of threads to pull and lock the pressing means within the enclosure body. Furthermore, the flange of the pressing means is modified into an angular shape 391, such as hexagonal, to facilitated the screwing of the pressing means into the enclosure body.

It is to be noted here, that the purpose of the main body in the first fixing means and of the enclosure body in the second fixing means is to provide material into which a cavity can be made. The disclosed embodiments of the first fixing means of the second fixing means are designed for a hollow frame. In case that the frame is full and composed of a resilient material, another embodiment of the invention has the main body and the enclosure body composed of the same material as the frame, so that the main body and the enclosure body are united with the frame material without a seam to become a monolithic part of the frame.

The stringing

The stringing proceeds in two steps. In the first stringing step, the longitudinal strings are attached. In particular, each longitudinal string is:

(a) threaded through the appropriate first fixing means, (b) pulled across the area enclosed by the inner head surface of the frame, (c) threaded through the enclosure body of the appropriate second fixing means, (d) threaded through the string clamping member, (e) threaded through the pressing means, (f) attached to a conventional string-tensioning means, (g) and tensed to the desired tension (i.e. the design-point tension).

The string is then fixed to the frame by pressing the pressing means into the enclosure body until the locking means engages.

To facilitate the alignment of the surface indentations between neighboring longitudinal strings, a marked plate of resilient material can be attached to the frame before the start of the first stringing step. The marked plate contains markings, preferably protruding from the surface of the plate, indicating the location that each transversal string will later occupy. By observing that the surface indentations on the longitudinal strings line-up with the plate's markings during the the first stringing step, one verifies that the longitudinal strings have the correct tension, and, contemporaneously, one is assured of the correct alignment of the surface indentations with respect to the transversal strings that will follow.

In the second step, each transversal string is:

(a) threaded through the appropriate first fixing means, (b) weaved through the longitudinal strings, (c) threaded through the enclosure body of the appropriate second fixing means, (d) threaded through the string clamping member, (e) threaded through the pressing means, (f) attached to a conventional string-tensioning means, and (g) is tensed to the desired tension (i.e. the design-point tension).

At this point the surface indentations on the transversal string will line-up with those on the longitudinal strings and the transversal string will interlock with the longitudinal strings. The pressing means is then pressed into the enclosure body until the locking means engages.

If adhesive is to be placed at the string crossings, the adhesive is added to the surface indentations on the longitudinal strings between the first stringing step and the second stringing step.

Although the description above contains many specificities, these should not be construed as limiting the scope of the invention but as merely providing illustrations of some of the presently preferred embodiments of this invention. Thus, the scope of the invention should be determined by the appended claims in the formal application and their legal equivalents, rather than by the examples given.

I claim:

1. A sports racket comprising:

a) a frame with a handle;

b) a throat connected to the handle;

c) a head connected to the throat, said head defining a central opening to be spanned by strings, said head having a means for securing strings to the frame;

d) a plurality of transversal strings running essentially parallel to each other and secured to the frame;

e) a plurality of longitudinal strings secured to the frame and running essentially orthogonal to, and in contact with, the transversal strings to form a substantially planar string network within the central opening, each contact of said transversal strings with said longitudinal strings being herein referred to as a string crossing; and f) at least one string crossing with at least one of the longitudinal strings involved in the string crossing having a first surface indentation positioned at the string crossing and localized in extent to said string crossing the transversal string involved in the string crossing having a second surface indentation positioned at the location of the string crossing and localized in extent to said string crossing the first surface indentation matching and interlocking with the second surface indentation at approximately a 90 degree angle to produce a common contact surface having a lateral portion thereof tilted away from the mid-plane of the substantially planar string network so as to support stresses leading to lateral forces that oppose the movement of the longitudinal string relative to the transversal string.

2. The sports racket of claim 1, further comprising an adhesively secured common contact surface, the adhesive allowing the presence of shear, compressive, and tensile stresses over said at least one common contact surface.

3. The sports racket of claim 2, wherein at least one string selected from the group consisting of the longitudinal strings and the transversal strings has a streamlined cross-section.

4. The sports racket of claim 3, wherein the streamlined cross-section is of elliptical form.

5. The sports racket of claim 1, wherein the longitudinal strings and the transversal strings are interwoven relative to each other and placed under tension.

6. The sports racket of claim 5, wherein at least one string selected from the group consisting of the longitudinal strings and the transversal strings has a streamlined cross-section.

7. The sports racket of claim 6, wherein the streamlined cross-section is of elliptical form.

8. In combination with a sport racket having a frame composed of a handle, a throat connected to the handle, and a head connected to the throat, the head defining a central opening to be spanned by strings, the head further having means for securing strings to the frame, the improvement comprising:

a plurality of transversal strings running essentially parallel to each other and secured to the frame by said means;

a plurality of longitudinal strings running essentially orthogonal to, and contacting with, the transversal strings to form a substantially planar sting network within the central opening, the longitudinal strings being secured to the frame by said means, each point of contact between transversal and longitudinal strings defining a string crossing; and at least one string crossing with at least one of the longitudinal strings involved in the string crossing having a first surface indentation positioned at said string crossing and localized in extent to said string crossing; the transversal string involved in the string crossing having a second surface indentation positioned at the location of the string crossing and localized in extent to the string crossing the first surface indentation matching and interlocking with the second surface indentation at approximately a 90 degree angle to produce a common contact surface having a lateral portion thereof tilted away from the mid-plane of the substantially planar string network so as to support stresses leading to lateral forces that oppose the movement of the longitudinal string relative to the transversal string.

9. A sports racket comprising:

a) a frame with a handle;

b) a throat connected to the handle;

c) a head connected to the throat, said head defining a central opening to be spanned by strings, said head having a means for securing strings to the frame;

d) a plurality of transversal strings running essentially parallel to each other and secured to the frame;

e) a plurality of longitudinal strings secured to the frame and running essentially orthogonal to, and in contact with, the transversal strings to form a substantially planar string network within the central opening, each contact of said transversal strings with said longitudinal strings being herein referred to as a string crossing;

f) at least one string crossing with a longitudinal string involved in the string crossing having a first surface enlarged section with a notched/formed indented surface at the said string crossing; having transversal string involved in the string crossing having a second elongated section with a notched/formed indented surface at the said crossing; having said first surface enlarged section and second surface elongated section matching and interlocking at approximately a 90 degree angle to produce a common contact surface having a lateral portion thereof tilted away from the mid-plane of the substantially planar string network so as to support stresses leading to lateral forces that oppose the movement of the longitudinal string relative to the transversal string; and g) said string crossing having a longitudinal and transversal notched/formed interlocking joint secured with an adhesive to form a substantially homogeneous planar string surface which distributes the shear, compressive, and tensile stresses that occur at the said string crossing when a tennis ball is hit to the said planar string surface.

10. In combination with a sport racket having a frame composed of a handle, a throat connected to the handle, and a head connected to the throat, the head defining a central opening to be spanned by strings, the head further having means for securing strings to the frame, the improvement comprising:

a plurality of transversal strings running essentially parallel to each other and secured to the frame by said means;

a plurality of longitudinal strings running essentially orthogonal to, and contacting with, the transversal strings to form a substantially planar string network within the central opening, the longitudinal strings being secured to the frame by said means, each point of contact between transversal and longitudinal strings defining a string crossing;

at least one string crossing with a longitudinal string involved in the string crossing having a first surface enlarged section with a notched/formed indented surface at the said string crossing; having a transversal string involved in the string crossing having a second elongated section with a notched/formed indented surface at the said string crossing; having said first surface enlarged section and second surface elongated section matching and interlocking at approximately a 90 degree angle to produce a common contact surface having a lateral portion thereof tilted away from the mid-plane of the substantially planar string network so as to support stresses leading to lateral forces that oppose the movement of the longitudinal string relative to the transversal string; and said string crossing having a longitudinal and transversal notched/formed interlocking joint secured with an adhesive to form a substantially homogeneous planar string surface which distributes the shear, compressive, and tensile stresses that occur at the said string crossing when a tennis ball is hit to the said planar string surface.

* * * * *